US011071884B2

(12) United States Patent
Brummond

(10) Patent No.: US 11,071,884 B2
(45) Date of Patent: Jul. 27, 2021

(54) OBJECTS AND METHODS FOR BUILDING SMALL MUSCLE FIBERS AND NERVES USING FLUID DISPOSED IN THE OBJECTS

(71) Applicant: Darren Brummond, Englewood, CO (US)

(72) Inventor: Darren Brummond, Englewood, CO (US)

( * ) Notice: Subject to any disclaimer, the term of this patent is extended or adjusted under 35 U.S.C. 154(b) by 0 days.

(21) Appl. No.: 16/487,826

(22) PCT Filed: Feb. 23, 2018

(86) PCT No.: PCT/US2018/019588

§ 371 (c)(1),
(2) Date: Aug. 21, 2019

(87) PCT Pub. No.: WO2018/157003

PCT Pub. Date: Aug. 30, 2018

(65) Prior Publication Data

US 2020/0054916 A1 Feb. 20, 2020

Related U.S. Application Data

(60) Provisional application No. 62/462,694, filed on Feb. 23, 2017.

(51) Int. Cl.
*A63B 21/06* (2006.01)
*A63B 41/02* (2006.01)
(Continued)

(52) U.S. Cl.
CPC ..... *A63B 21/0602* (2013.01); *A63B 21/075* (2013.01); *A63B 41/02* (2013.01);
(Continued)

(58) Field of Classification Search
CPC ... A63B 21/0602; A63B 21/075; A63B 41/02; A63B 71/0622; A63B 2102/14;
(Continued)

(56) References Cited

U.S. PATENT DOCUMENTS 1,366,200 A 1/1921 Antone
3,226,117 A 12/1965 Walklet
(Continued)

FOREIGN PATENT DOCUMENTS

CN 203121822 U 8/2013
CN 204764973 U 11/2015
(Continued)

OTHER PUBLICATIONS

International Search Report and Written Opinion for PCT/US2018/019588, dated Apr. 27, 2018 (9 pages).
(Continued)

*Primary Examiner* — Nyca T Nguyen
(74) *Attorney, Agent, or Firm* — Suiter Swantz pc llo

(57) ABSTRACT

The present disclosure provides for various objects (weights, playing apparatuses, balls, clothing, etc.) that have liquid disposed in them to assist in building and strengthening small muscle fibers and/or nerves. The various objects can include weights, playing apparatuses such as objects that can be swung in sports, balls, and clothing or other objects that can be worn by humans or other animals. The objects include fluid paths and re¬directions walls disposed within the fluid paths to direct fluid flow to particular areas within the objects. The designated areas to where fluid flow is directed aid in development of small muscle fibers and/or nerves due to the fluid sloshing around at those particular locations. Methods of making and using the various objects disclosed are also provided.

30 Claims, 9 Drawing Sheets

(51) Int. Cl.

| | |
|---|---|
| ***A63B 102/14*** | (2015.01) |
| ***A63B 102/20*** | (2015.01) |
| ***A63B 59/50*** | (2015.01) |
| ***A63B 59/06*** | (2006.01) |
| ***A63B 21/075*** | (2006.01) |
| ***A63B 71/06*** | (2006.01) |
| *A63B 59/60* | (2015.01) |

(52) U.S. Cl.
CPC ..... *A63B 71/0622* (2013.01); *A63B 59/50* (2015.10); *A63B 59/60* (2015.10); *A63B 2102/14* (2015.10); *A63B 2102/20* (2015.10); *A63B 2225/09* (2013.01); *A63B 2225/20* (2013.01)

(58) Field of Classification Search
CPC ..... A63B 2102/20; A63B 59/50; A63B 59/60; A63B 2225/09; A63B 2225/20; A63B 2209/00; A63B 2243/0025; A63B 2243/0037; A63B 2243/0054; A63B 2243/0066; A63B 2243/007; A63B 2102/24; A63B 2102/34; A63B 2102/18; A63B 39/00; A63B 49/02; A63B 53/00; A63B 21/06; A63B 69/00; A63B 21/0603
See application file for complete search history.

(56) References Cited

U.S. PATENT DOCUMENTS 3,231,270 A 1/1966 Marvin
3,572,702 A 3/1971 Dorn
3,843,117 A * 10/1974 Johnson ..... A63B 21/0602 482/110
4,103,887 A 8/1978 Shoofler
4,199,140 A 4/1980 Ferretti
D271,408 S 11/1983 Bauer
4,448,418 A * 5/1984 McNeill ..... A63B 43/04 273/123 A
4,541,631 A * 9/1985 Sasse ..... A63B 21/0602 473/297
4,575,074 A 3/1986 Damratoski
4,854,575 A 8/1989 Wilson et al.
4,854,576 A 8/1989 McWain
4,997,184 A 3/1991 Sherman
5,050,870 A 9/1991 Pollock
5,056,778 A * 10/1991 Hull ..... A63B 21/0602 482/105
5,070,610 A * 12/1991 Leslie ..... A63B 43/04 29/899.1
5,312,314 A 5/1994 Stephan et al.
5,393,285 A 2/1995 Fischer, Sr. et al.
5,431,615 A * 7/1995 Correll ..... A63B 21/0602 446/267
5,445,587 A * 8/1995 Brown ..... A63B 21/0602 482/108
5,509,877 A 4/1996 Adams
5,577,723 A * 11/1996 DiResta ..... A63H 3/00 446/184
5,628,697 A * 5/1997 Gamble ..... A63B 53/08 473/326
5,749,799 A * 5/1998 Jasperson ..... A63B 43/00 40/406
5,842,957 A 12/1998 Wheeler
5,857,946 A 1/1999 Brown
5,967,952 A 10/1999 Bronstein et al.
5,971,864 A 10/1999 Joshi et al.
6,582,274 B1 * 6/2003 Chernek ..... A63H 5/00 446/188
6,645,098 B1 * 11/2003 Quinn ..... A63B 43/04 473/594
6,758,795 B2 7/2004 Barber
8,029,393 B2 10/2011 Frazier
8,469,865 B2 6/2013 Verheem
8,727,951 B2 5/2014 Jones et al.
8,870,717 B2 10/2014 Pfitzer
8,911,334 B1 12/2014 Cotter et al.
9,022,906 B1 5/2015 Nelson
9,289,657 B1 * 3/2016 Rice ..... A63B 43/04
9,446,283 B2 9/2016 Nelson
9,486,664 B2 11/2016 Prenatt
9,623,274 B2 4/2017 Holt, IV et al.
2005/0065002 A1 3/2005 Su
2006/0094572 A1 5/2006 Vanderploeg
2006/0205544 A1 * 9/2006 Wyner ..... A63B 41/00 473/569
2006/0276270 A1 12/2006 Haney
2007/0184938 A1 * 8/2007 Krietzman ..... A63B 21/00 482/92
2009/0318054 A1 * 12/2009 Wong ..... A63B 41/00 446/220
2011/0003655 A1 * 1/2011 Chernick ..... A63B 39/00 473/594
2011/0251029 A1 * 10/2011 Verheem ..... A63B 41/00 482/110
2011/0251030 A1 10/2011 Pfitzer
2013/0225323 A1 * 8/2013 Molinari ..... A63B 37/0045 473/369
2013/0310229 A1 11/2013 Kovach
2013/0316881 A1 11/2013 Verheem
2014/0249002 A1 * 9/2014 Fischer ..... A63B 21/0602 482/106
2014/0274611 A1 * 9/2014 Rex ..... A63B 43/02 482/139
2015/0141220 A1 * 5/2015 Wargo ..... A63B 21/072 482/139
2015/0196790 A1 7/2015 Escueta
2016/0008672 A1 * 1/2016 Johnson ..... A63B 41/00 473/594
2017/0001060 A1 1/2017 D'Alesio
2017/0095689 A1 * 4/2017 Weck ..... A63B 23/14

FOREIGN PATENT DOCUMENTS

CN 205235256 U 5/2016
EP 0168085 A1 1/1986
RU 2115403 C1 7/1998

OTHER PUBLICATIONS

Australian First Examination Report for Application No. 2018223834, dated Nov. 8, 2019 (5 pages).
Chinese Office Action for Application No. 201880020995, dated Oct. 26 ,2020 (10 pages).
Japanese Office Action for Application No. 2019-546881 dated Jan. 28, 2020 (8 pages).
Partial Supplemental European Search Report for Application No. 18757766.3, dated Dec. 14, 2020 (14 pages).

* cited by examiner

OBJECTS AND METHODS FOR BUILDING SMALL MUSCLE FIBERS AND NERVES USING FLUID DISPOSED IN THE OBJECTS

CROSS REFERENCE TO RELATED APPLICATION

The present application claims priority to and the benefit of U.S. Provisional Application No. 62/462,694, filed on Feb. 23, 2017, and titled "LW, Liquids Weights is liquids in weights using kinetic energy in lifting device used to maintain or rehabilitate athletes, humans in general, and animals to build muscle fibers," the content of which is incorporated herein by reference in its entirety.

FIELD

The weight lifting industry help people and animals develop, maintain, and rehabilitate muscle through lifting weights. Muscles can rebuild and get stronger through weight lifting in animals and humans.

BACKGROUND

The weight lifting industry focuses more on maintaining, rebuilding and developing muscle fiber by building the larger muscles. When the larger muscle fibers are being focused on, smaller muscle fibers like proprioception and neuromuscular junction do not get the attention they deserve.

When the weight lifting community from athletes, to the average Joe, focuses on more of the large muscle groups when working out, or during physical therapy, the value in the weight lifting workout goes down. For the proprioception and neuromuscular junction get ignored when lifting solid weights, creating more of a focus on the larger muscle groups. When an athlete focuses more on larger muscle fibers and ignores the smaller muscle fibers, the athlete may be more prone to injury or unable to perform at his or her highest level because the small muscle fibers were ignored when working out. The person who is in physical therapy repairing an injured shoulder may have a longer recovery time do to the fact of focusing on larger muscle fiber during their physical therapy.

The days were larger muscle fiber is the only muscle fiber being focused on is over. People and animals want to get a well-rounded workout or rehabilitation by including the larger and smaller muscle fibers when working certain muscle groups. This ultimately may add more value to building muscle fiber and enhance the recovery time of an injury or help build small and large muscle fiber giving more value in a workout or physical therapy. It would be nice to have systems in place were large and small muscle fibers in humans and animals can be worked at the same time which would add more value when developing small and large muscle fiber.

SUMMARY

The present disclosure helps build small muscle fiber by focusing in on the development of neuromuscular junctions. In particular, the present disclosure provides for various objects (weights, playing apparatuses, balls, clothing, etc.) that have liquid disposed therein to assist in building and strengthening small muscle fibers and/or nerves. In particular, the objects have particular configurations formed within the objects to help direct fluid to particular locations that aid in development of small muscle fibers and/or nerves. The fluid paths formed in the objects are enhanced by including one or more re-direction or inner walls within the path to help re-direct fluid to desired locations where the strengthening of the small muscle fibers and/or nerves can occur. As a result, the fluid in the fluid path can be re-directed by the re-direction walls to one or more particular locations within the object (sometimes referred to as designated focus locations). The location of the one or more particular locations to which fluid is directed can be positioned such that they help strengthen and build small muscle fibers and nerves for the user, which can include humans and other animals (e.g., horses). The objects in which these teachings can be used are many, including various types of weights (e.g., weight plates, barbells, jugs), balls (e.g., footballs, rugby balls, basketballs, soccer balls, baseballs, bowling balls, lacrosse balls, water polo balls, hockey pucks), playing apparatuses (e.g., tennis racquets, bats such as for baseball and cricket, polo mallets, lacrosse sticks, hockey sticks, golf clubs), and articles of clothing (e.g., medical braces, vests, shirts, pants, shorts, backpacks, saddles, saddle-lick packs), among other objects. Incorporating the disclosures related to fluid paths and re-direction walls, among other features provided for herein (e.g., liquids, liquids having materials disposed therein, etc.) into many different types of objects without departing from the spirit of the present disclosure. The objects provided for in the present disclosure can be generally summarized as Liquid Weights Technology, or LW or LWT.

In one exemplary embodiment, a weight is provided that includes a housing, a fluid path disposed within the housing, one or more re-direction walls disposed within the fluid path, and a fluid disposed within the fluid path. The fluid path is defined by an inner wall that has a substantially cylindrical or substantially circular cross-sectional shape across at least a substantial length of the fluid path. The fluid path also has at least one designated focus location formed in it. The one or more re-direction walls extend radially inward from the inner wall of the fluid path so as to tortuously redirect fluid to a different location along the fluid path than fluid travel would otherwise travel when passing through the fluid path. The one or more re-direction walls are configured to direct fluid to one or more of the at least one designated focus locations. The fluid is configured to slosh in the fluid path to create kinetic energy. The fluid is directed through the fluid path to one or more of the at least one designated focus locations based on particular motions applied to the housing. The one or more re-direction walls can help in directing the fluid to the designated focus location(s).

A person skilled in the art will understand other shapes of the fluid path are possible without departing from the spirit of the present disclosure. This is true for this described embodiment, as well as all other embodiments provided for herein. Further, a person skilled in the art will understand that reference to a substantial length of the fluid path indicates that the fluid path has the desired shape for at least half of the path formed in the housing, if not more. This is likewise true for this described embodiment, as well as other embodiments provided for herein. The one or more of the at least one designated focus locations in any of the described embodiments can be disposed at a location that is conducive to create the desired kinetic energy to build at least one of small muscle fibers and nerves for a user (e.g., human or other animal).

In some embodiments, the housing can include one of a weight plate, a barbell, and a jug. Other types of weights can also be used without departing from the spirit of the present disclosure. The fluid can include a liquid having one or more materials disposed in the liquid. Various types of materials are provided for below and/or can be incorporated by those skilled in the art in view of the present disclosure. The addition of materials in liquid can change a flow and/or viscosity of the liquid.

The weight can also include one or more fluid control elements that are configured to selectively control movement of the fluid through the fluid path and/or selectively control movement of the fluid to the at least one or more of the at least one designated focus locations and/or selectively control movement of the fluid with respect to contacting the one or more re-direction walls. Fluid control elements can include valves and other known features that can be used to stop, start, or otherwise change a flow of fluid through an orifice (the orifice being the fluid path).

In another exemplary embodiment, a ball is provided that includes an outer layer, a fluid path disposed within the outer layer, one or more re-direction walls disposed within the fluid path, and a fluid disposed within the fluid path. The fluid path is defined by an inner wall that has a substantially cylindrical or substantially circular cross-sectional shape across at least a substantial length of the fluid path. The fluid path also has at least one designated focus location formed in it. The one or more re-direction walls extend radially inward from the inner wall of the fluid path so as to tortuously redirect fluid to a different location along the fluid path than fluid travel would otherwise travel when passing through the fluid path. The one or more re-direction walls are configured to direct fluid to one or more of the at least one designated focus locations. The fluid is configured to slosh in the fluid path to create kinetic energy. The fluid is directed through the fluid path to one or more of the at least one designated focus locations based on particular motions applied to the ball. The one or more re-direction walls can help in directing the fluid to the designated focus location(s).

The ball can include a bladder that can be disposed within the outer layer. In some such embodiments, the fluid path can be disposed within the bladder. In some embodiments, the ball can be one of a football, a rugby ball, a basketball, a soccer ball, a baseball, a cricket ball, a bowling ball, a lacrosse ball, a water polo ball, and a hockey puck. Other types of balls can also be used without departing from the spirit of the present disclosure, particularly those that can be somehow carried, thrown, and/or kicked by a user. The fluid can include a liquid having one or more materials disposed in the liquid. Various types of materials are provided for below and/or can be incorporated by those skilled in the art in view of the present disclosure. The addition of materials in liquid can change a flow and/or viscosity of the liquid.

The ball can also include one or more fluid control elements that are configured to selectively control movement of the fluid through the fluid path and/or selectively control movement of the fluid to the at least one or more of the at least one designated focus locations and/or selectively control movement of the fluid with respect to contacting the one or more re-direction walls. Fluid control elements can include valves and other known features that can be used to stop, start, or otherwise change a flow of fluid through an orifice (the orifice being the fluid path).

In still another exemplary embodiment, a playing apparatus is provided that includes a housing having a handle associated with it, a fluid path disposed within the housing, one or more re-direction walls disposed within the fluid path, and a fluid disposed within the fluid path. The fluid path is defined by an inner wall that has a substantially cylindrical or substantially circular cross-sectional shape across at least a substantial length of the fluid path. The fluid path also has at least one designated focus location formed in it. The one or more re-direction walls extend radially inward from the inner wall of the fluid path so as to tortuously redirect fluid to a different location along the fluid path than fluid travel would otherwise travel when passing through the fluid path. The one or more re-direction walls are configured to direct fluid to one or more of the at least one designated focus locations. The fluid is configured to slosh in the fluid path to create kinetic energy. The fluid is directed through the fluid path to one or more of the at least one designated focus locations based on particular motions applied to the housing, for instance by way of a user gripping the handle. The one or more re-direction walls can help in directing the fluid to the designated focus location(s).

There are many different types of playing apparatuses that can be encompassed by this embodiment, including but not limited to tennis racquets, bats, polo mallets, lacrosse sticks, hockey sticks, and golf clubs. Other types of playing apparatuses can also be used without departing from the spirit of the present disclosure, particularly those that can be somehow swung by an arm and/or leg. More particularly, in some instances the housing can include a throat and a racquet head such that the playing apparatus is a tennis racquet. In some instances, the housing can include a barrel and the playing apparatus is a bat (e.g., baseball or cricket). In still other instances, the housing can include a shaft and a mallet head such that the playing apparatus is a polo mallet. Still further, in some instances the housing can include a shaft and a head having a pocket associated with the head such that the playing apparatus is a lacrosse stick. In other instances, the housing can include a shaft and a blade such that the playing apparatus is a hockey stick. In yet other instances, the housing can include a shaft and a head such that the playing apparatus is a golf club.

The fluid can include a liquid having one or more materials disposed in the liquid. Various types of materials are provided for below and/or can be incorporated by those skilled in the art in view of the present disclosure. The addition of materials in liquid can change a flow and/or viscosity of the liquid.

The playing apparatus can also include one or more fluid control elements that are configured to selectively control movement of the fluid through the fluid path and/or selectively control movement of the fluid to the at least one or more of the at least one designated focus locations and/or selectively control movement of the fluid with respect to contacting the one or more re-direction walls. Fluid control elements can include valves and other known features that can be used to stop, start, or otherwise change a flow of fluid through an orifice (the orifice being the fluid path).

In another exemplary embodiment, an article of clothing is provided that includes an outer layer that is configured to be worn as apparel, a fluid path disposed within the outer layer, one or more re-direction walls disposed within the fluid path, and a fluid disposed within the fluid path. The fluid path is defined by an inner wall that has a substantially cylindrical or substantially circular cross-sectional shape across at least a substantial length of the fluid path. The fluid path also has at least one designated focus location formed in it. The one or more re-direction walls extend radially inward from the inner wall of the fluid path so as to tortuously redirect fluid to a different location along the fluid path than fluid travel would otherwise travel when passing through the fluid path. The one or more re-direction walls are configured to direct fluid to one or more of the at least one designated focus locations. The fluid is configured to slosh in the fluid path to create kinetic energy. The fluid is directed through the fluid path to one or more of the at least one designated focus locations based on particular motions applied to the article of clothing. The one or more re-direction walls can help in directing the fluid to the designated focus location(s).

In some embodiments, the article of clothing can be one of a medical brace, a vest, a shirt, pants, shorts, a backpack, a saddle, and a saddle-like pack. Other types of articles of clothing or other textiles and/or objects worn in some way by a human or other animal can also be used without departing from the spirit of the present disclosure. The fluid can include a liquid having one or more materials disposed in the liquid. Various types of materials are provided for below and/or can be incorporated by those skilled in the art in view of the present disclosure. The addition of materials in liquid can change a flow and/or viscosity of the liquid.

The article of clothing can also include one or more fluid control elements that are configured to selectively control movement of the fluid through the fluid path and/or selectively control movement of the fluid to the at least one or more of the at least one designated focus locations and/or selectively control movement of the fluid with respect to contacting the one or more re-direction walls. Fluid control elements can include valves and other known features that can be used to stop, start, or otherwise change a flow of fluid through an orifice (the orifice being the fluid path).

An exemplary method of building at least one of muscle and nerves includes applying a force to an object having a fluid path formed in the object. The fluid path is defined by an inner wall having a substantially cylindrical or substantially circular cross-sectional shape across at least a substantial length of the path. One or more re-direction walls extend radially inward from the inner wall of the fluid path. Applying the force to the object causes fluid disposed within the fluid path to slosh in the path, thereby creating kinetic energy. As a result, portions of the fluid make contact with at least one of the one or more re-direction walls to direct fluid to at least one designated focus location based on the force applied to the object to strengthen at least one of small muscle fibers and nerves of a user applying the force.

In some embodiments, the object is one of a weight, a ball, a playing apparatus, and an article of clothing. If the object is a weight, it can be one of a weight plate, a barbell, and a jug, among other types and shapes of weights known to those skilled in the art. If the object is a ball, it can be one of a football, a rugby ball, a basketball, a soccer ball, a baseball, a cricket ball, a bowling ball, a lacrosse ball, a water polo ball, and a hockey puck, among others types of balls. If the object is a playing apparatus, it can be one of a tennis racquet, a bat (e.g., baseball or cricket), a polo mallet, a lacrosse stick, a hockey stick, and a golf club, among other types of playing apparatuses. If the object is an article of clothing, it can be one of a medical brace, a vest, a shirt, pants, shorts, a backpack, a saddle, and a saddle-like pack, among other types of articles of clothing or other textiles and/or objects worn in some way by a human or other animal.

The fluid disposed in the fluid path can include a liquid having one or more materials disposed in the liquid. Various types of materials are provided for below and/or can be incorporated by those skilled in the art in view of the present disclosure. The addition of materials in liquid can change a flow and/or viscosity of the liquid. In some embodiments, the method can further include adjusting at least one of the fluid path and a location of the one or more re-direction walls to adjust a manner by which fluid passes through the fluid path. This can be achieved, for example, by way of fluid control elements such as valves and other known features that can be used to stop, start, or otherwise change a flow of fluid through an orifice (the orifice being the fluid path).

BRIEF DESCRIPTION OF DRAWINGS

This disclosure will be more fully understood from the following detailed description taken in conjunction with the accompanying drawings, in which.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure.

The present disclosure helps build small muscle fiber by focusing in on the development of neuromuscular junctions. In particular, the present disclosure provides for various objects (weights, playing apparatuses, balls, clothing, etc.) that have liquid disposed therein to assist in building and strengthening small muscle fibers and/or nerves. In particular, the objects have particular configurations formed within the objects to help direct fluid to particular locations that aid in development of small muscle fibers and/or nerves. The fluid paths formed in the objects are enhanced by including one or more re-direction walls (also referred to as inner walls herein) within the path to help re-direct fluid to desired locations where the strengthening of the small muscle fibers and/or nerves can occur. As a result, the fluid in the fluid path can be re-directed by the re-direction walls to one or more particular locations within the object (sometimes referred to as designated focus locations). The location of the one or more particular locations to which fluid is directed can be positioned such that they help strengthen and build small muscle fibers and nerves for the user, which can include humans and other animals (e.g., horses). The objects in which these teachings can be used are many, including various types of weights (e.g., weight plates, barbells, jugs), balls (e.g., footballs, rugby balls, basketballs, soccer balls, baseballs, bowling balls, lacrosse balls, water polo balls, hockey pucks), playing apparatuses (e.g., tennis racquets, bats such as for baseball and cricket, polo mallets, lacrosse sticks, hockey sticks, golf clubs), and articles of clothing (e.g., medical braces, vests, shirts, pants, shorts, backpacks, saddles, saddle-lick packs), among other objects. Incorporating the disclosures related to fluid paths and re-direction walls, among other features provided for herein (e.g., liquids, liquids having materials disposed therein, etc.) into many different types of objects without departing from the spirit of the present disclosure.

Figure 1:
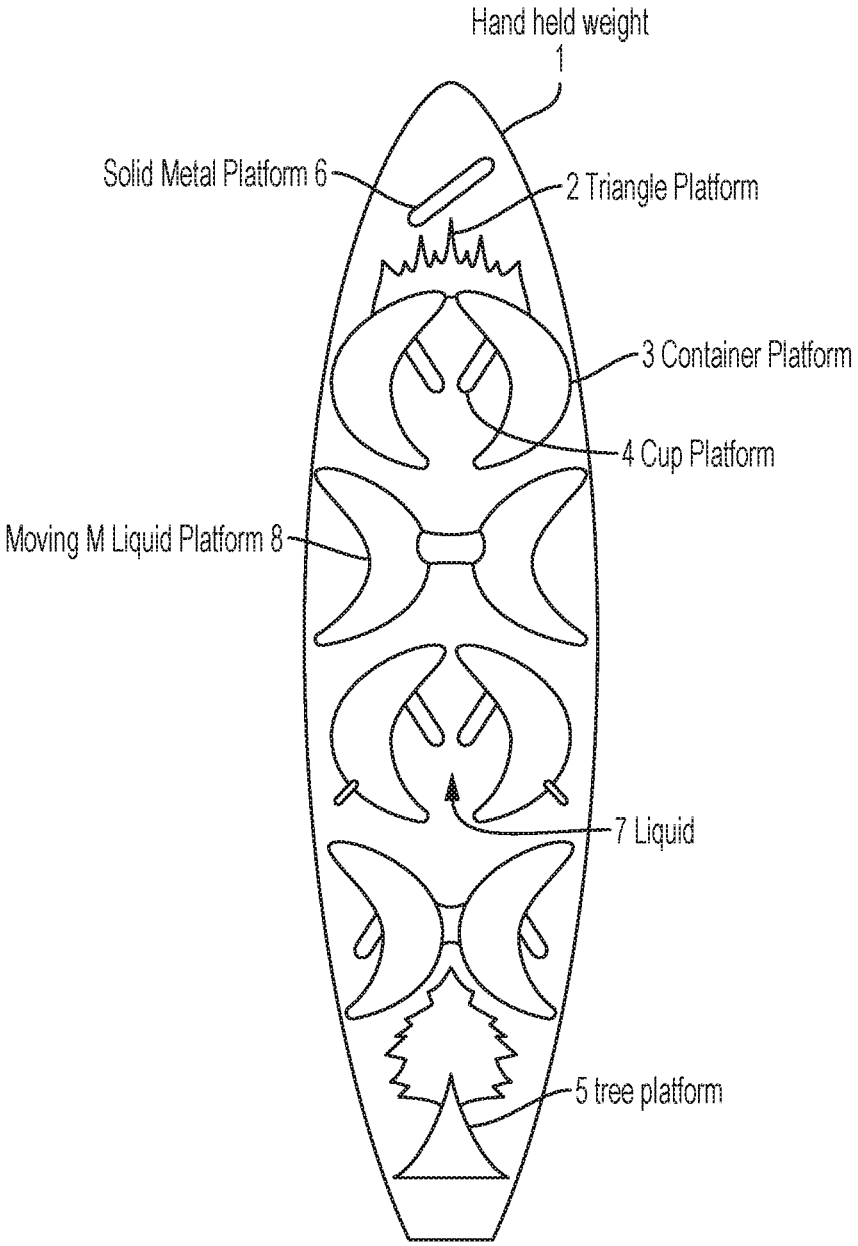
FIG. 1 is a schematic cross-sectional top view of one exemplary embodiment of a hand-held weight of the present disclosure.
Figure 2:
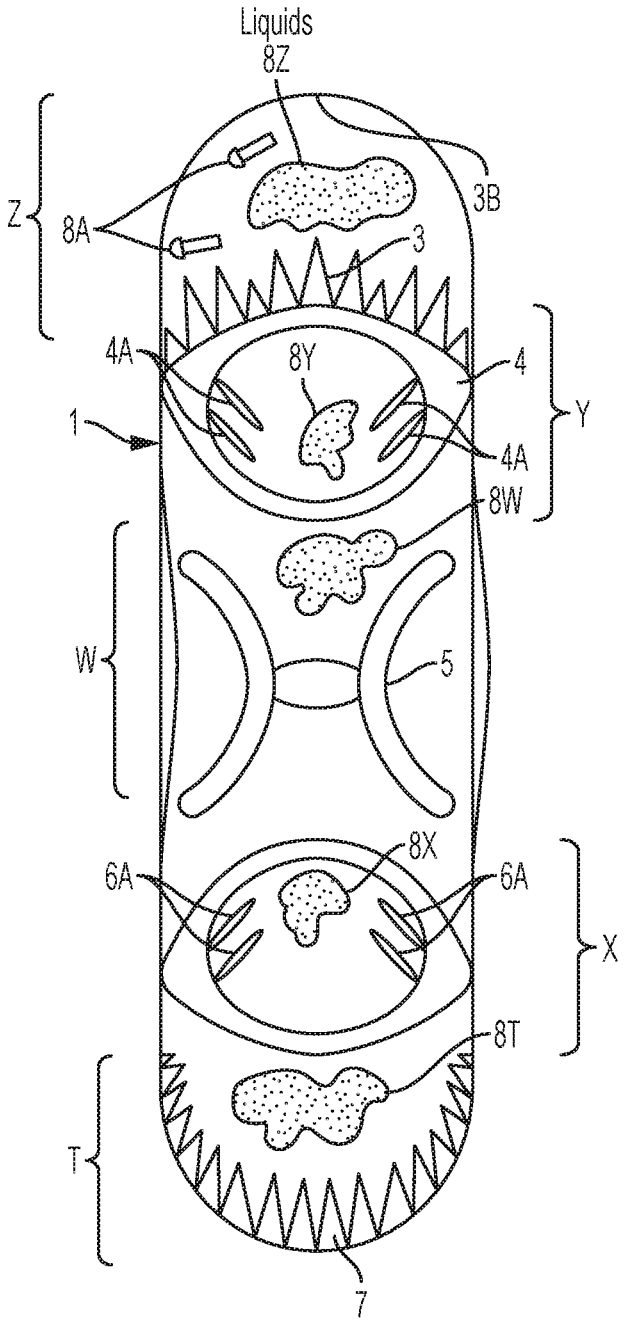
FIG. 2 is a schematic cross-sectional top view of another exemplary embodiment of a hand-held weight of the present disclosure, similar to that of FIG. 1.

Hand-Held Weight that can be Connected to Either End of a Polo Mallet (Aka a Wand), Other Object, or Used Independently Hand held weight which can be connected to either end of a polo mallet, aka wand, is illustrated in FIGS. 1 and 2, with reference herein generally being made to FIG. 2 unless otherwise understood to be referencing FIG. 1. FIG. 1 is intended to provide a higher level overview of this type of embodiment, while FIG. 2 provides more detail. This particular weight can be held in the middle or along any part of the housing to get a different type of kinetic energy which will focus on the process in which nerve endings in the muscles and joints are stimulated better known as proprioception. Every different hand location on the weight or the polo mallet, aka wand, can produce a different kind of kinetic energy, which in fact the body will sense movement and the nerve endings in the muscles and joints will adjust to develop the small nerve and muscle fibers getting a human or animal stronger. This particular weight also has five intertwined separate housing departments or sections which contain its own fluid path, which the inner walls direct the fluid to at least one designated focus location based on the force applied while creating kinetic energy to the weight to strengthen small nerves and muscle fibers of a user applying the force. Parts Z, Y, W, X and T will show the separated housing departments which contain fluid manipulated by inner walls.

Located in the housing of the weight, certain inner walls (also referred to herein as re-direction walls) can have a substantially cylindrical or substantially circular cross-sectional shape across at least a substantial length of a fluid path that will help create kinetic energy in a desired location of the housing which will create a vibration, which the neurological control of the body/animal will sense the vibration and kinetic energy, helping focus on the proprioception. Ultimately helping humans and animals get stronger while building the nerve endings in the muscles while the weight/housing is being moved in all different types of direction, side to side, up and down and all around to get the desired kinetic energy for focusing on specific nerves and muscles.

This particular inner wall in housing section Z is designed like the teeth of a shark or like the Rocky Mountains and sits on inner wall 4. When the fluid path is changed and being defined by this inner wall, creating a diversion of the liquids or fluid path from the point of were the fluid hits the inner wall, 3, or shark teeth/Rocky Mountains in this example, the fluid will be redirected back against the side of the housing in section Z, known as 3B, causing kinetic energy in these two particular parts of the weight, part 3 and 3B. Creating kinetic energy in part 3 and 3B within the housing can help the body or animal use position sense and respond consciously or unconsciously to stresses imposed from the liquids weights sloshing back and forth in section Z. This can help create kinetic energy focusing on the outer proprioception of nerve endings in the muscles and joints which are stimulated.

This particular inner wall is firmly fixed to the housing, 1, developed to hold its own fluid in section Y, separate from the fluid in section Z, W, X, and T. In other instances, it does not have to be firmly fixed, as it can be releasably connected or configured in other known manners for associating inner walls and housings. Inside this inner wall, labeled as 4, has an inner housing with inner walls labeled as 4A. These inner walls, 4A, extend inward redirecting the fluid path having at least one designated focus location to create the desired slosh and kinetic energy in the designed area. As the fluid sloshes around in the inner wall of 4, the inner walls of 4A redirect the fluid path creating kinetic energy/vibration in section Y of the housing. This section Y can create kinetic energy within the housing focusing on the inner proprioception of said nerve endings in the muscles and joints which are stimulated.

In section W of the housing, this inner wall, 5, is not attached to the housing and is a free flowing wall which can crash up against the housing in section W, the stationary wall labeled as 4 and the stationary wall labeled as 6 which is identical to inner wall 4. In the inner wall labeled as 5, it is designed to be a heavier wall so when it does crash up against said walls/housing, the crash creates a vibration or kinetic energy which will trigger proprioception in a different way than the inner walls of 3, 4, 4A, 6 and 6A, and 7. The combination of kinetic/vibration of all inner walls inside of the housing can help in the development of nerve endings in the muscles and joints which can be stimulated by the kinetic energy created by the redirection of the fluid path.

This inner wall, in section X of the housing, can be the same as inner wall 4 section Y, but the inner wall of 6A can also be designed differently than inner wall 4A. for example, the inner wall of 6A can go in the opposite direction of inner wall 4A. The inner wall of 6A can extend inward redirection the fluid path having at least one designated focus location to create the desired slosh and kinetic energy in the designed area within the housing.

This inner wall, in section T of the housing, can be the same as inner wall 3, but can sit on the housing end of the weight, creating the opposite effect of inner wall 3. Instead of getting the kinetic energy from the interior of the housing, the kinetic energy can be being focused on the end of the housing attached to the weight. As described herein, the fluid path and the inner walls work to direct fluid to designated force locations.

In these sections, Z, Y, W, X, T, the liquids can be formulated differently to get the desired effect of the weight. In section Z, the liquids have a combination of $H_2O$, corn starch, and two free floating rods labeled as 8A. The corn starch can be added to create less of a slosh than $H_2O$ by itself. The rods can be in the Z section to penetrate through the liquids by creating its own kinetic energy. In section Y, the liquids are just $H_2O$. In section W the liquids have a salt mixture of salt and $H_2O$ added to increase the weight of the total housing. Section X is the same as section Y as it pertains to the liquids. In section T, the liquids derive of $H_2O$, corn starch and metal BB's to penetrate through the mixture of liquids giving a different effect than the rest of the liquids inside of the housing. A person skilled in the art, in view of the present disclosures, will understand many other changes that can be made to the liquid or fluid disposed within the fluid path to change the viscosity, flow rate, etc. of the fluid, and thus change the effect on the user as well.

This housing is designed to get different types of kinetic energy and vibration to ultimately develop neuromuscular control and proprioception by using the device as a weight or on the end or on both ends of the wand/polo mallet. In other words, the design of this housing is such that it can serve as a standalone weight, or alternatively, it can be adapted to be used as a mallet head of a polo mallet. Other dual-purposes designs can also be achieved for weights and playing apparatuses in view of the present disclosure.

Figure 3:
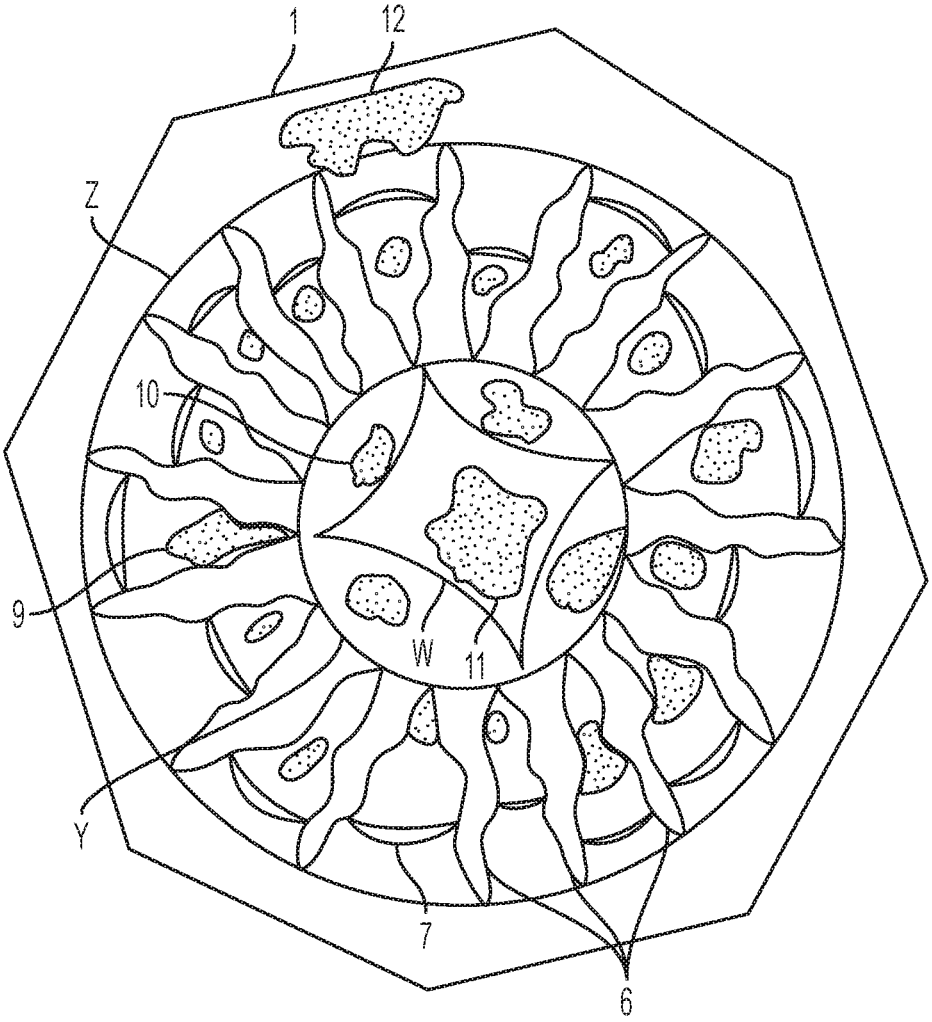
FIG. 3 is a schematic cross-sectional top view of yet another exemplary embodiment of a hand-held weight of the present disclosure.
Figure 4:
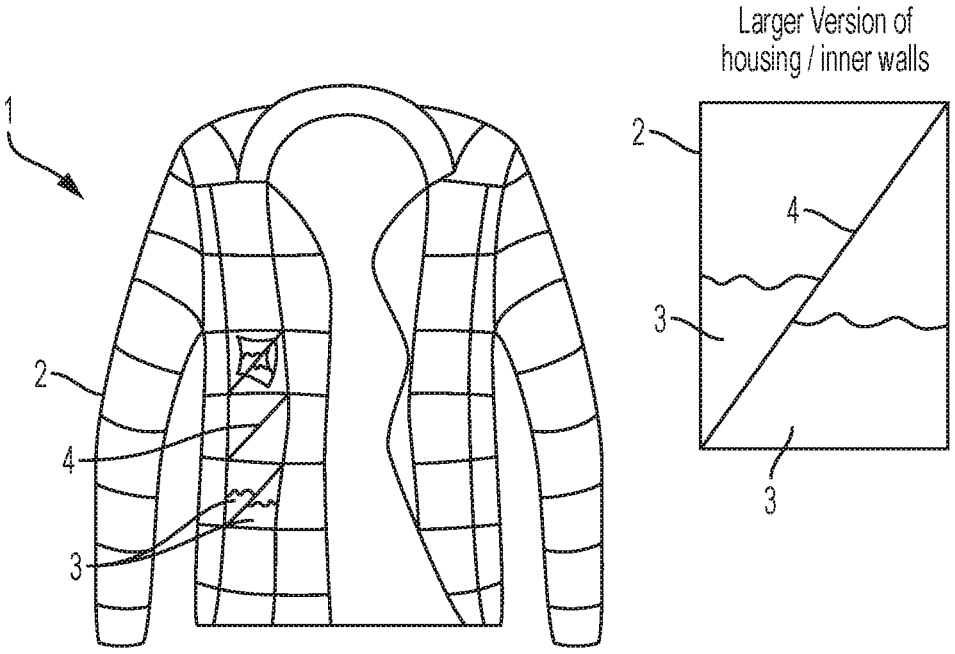
FIG. 4 is a schematic front view of one exemplary embodiment of a running suit of the present disclosure, including a schematic detailed portion of the running suit illustrated in the same.

Plate Weight that can be Grabbed in Different Locations to Get a Different Effect while Using Liquids Weights Technology FIG. 3 provides for another hand held plate weight. The weight can be divided into any number of housings. As shown, the present weight is divided into 8 different housing sections to complete one whole housing plate weight. Theses housings can be used by the user in separate housing sections of 1, 2, 3, 4, 5, 6, 7, and 8 housings. This particular weight can be held or hung around the user to get a different type of kinetic energy which will focus on the process in which nerve endings in the muscles and joints are stimulated better known as proprioception. Different location on the housing will produce different kinds of kinetic energy which in fact the user, which encompasses animals, including humans, horses, etc., will sense movement and the nerve endings in the muscles and joints will adjust to develop the small nerve and muscle fibers getting a user stronger. This particular weight also has 3 intertwined separate housing departments which each contain their own fluid paths, and liquid structure, which the inner walls encompass a platform that direct the fluid to at least one designated focus location based on the force applied while creating kinetic energy to the weight, to strengthen small nerves and muscle fibers of a user applying the force. Part Z, Y, W, can show the separated housing departments which may contain fluid manipulated by inner walls contained in the housing.

Located in the housing of the weight, certain inner walls can have a substantially cylindrical or substantially circular cross-sectional shape across at least a substantial length of a fluid path that will help create kinetic energy in a desired location of the housing which will create a vibration, which the neurological control of the body/animal will sense the vibration and kinetic energy, helping focus on the proprioception. Ultimately helping the user get stronger while building the nerve endings in the muscles while the weight/housing is being moved in all different types of direction, side to side, up and down and all around, to get the desired kinetic energy for focusing on specific nerves and small muscle fiber to get stronger.

The first housing known as Z, within the housing of the entire weight can have a radial symmetry of inner walls connected to the second housing known as Y, which in the illustrated embodiment is not connected to the third housing known as W, as the third housing sloshes around inside the space of the second inner housing which is located in the center/middle of the plate weight. The second housing, Y can incase the third housing which can be free to flow inside of the second housing. The third housing, W, can be in the middle of the weight and can be free to flow and crash into the second housing, Y.

In the first housing know as housing Z, there may be more re-direction walls disposed within the fluid path, the one or more-redirection walls extending radially inward from the inner wall of the fluid path so as to tortuously redirect fluid to a different location along the fluid path than fluid travel would otherwise travel when passing through the fluid path, the one or more re-direction inner walls being configured to direct fluid to one or more of the at least one designated focus locations and a fluid disposed within the fluid path and configured to slosh and create kinetic energy therein. These inner walls curve inward and outward creating different kinds of kinetic energy and vibrations in the Z housing area.

To stop the flow of the fluid path associated with the inner walls of 6, an inner wall may be placed in between the inner walls labeled as 6. Therefore, the fluid may slosh up and down, side to side, with movement of the plate weight/housing crashing against inner wall of 7. The inner wall (fluid control element) 7 can be placed closer to the inner housing labeled as Y or placed further away from the Y housing structure to get the desired slosh, creating the desired kinetic energy for proprioception and neurological control for the user.

The housing area labeled as W can be free flowing with inner walls to direct the fluid path and create kinetic energy as the user moves the whole housing department around. This liquid, labeled as 9, trapped in between the inner walls of 6 and 7 may contain a $H_2O$ and salt liquid. This liquid, labeled as 10, can be trapped within housing Y and may contain a $H_2O$, salt and corn starch liquid. The liquid, labeled as 11, can be trapped within housing W and may contain the same liquid as 9. The liquid, labeled as 12, can be trapped in between inner wall 7 and the outer housing labeled as 1 can be a $H_2O$ liquid. This housing is designed to get different types of kinetic energy and vibration to ultimately develop neuromuscular control and proprioception by using the housing and grabbing the housing in different ways.

Running Suit with Liquid Weights Technology Inside of Gore Tex Jacket

Running suit with Liquids Weights Technology inside of the housing bladder. This particular suit can be used during training to get kinetic energy from the housing placed inside of the suit which will focus on the process in which nerve endings in the muscles and joints are stimulated better known as proprioception. The fluid path within the housing can create kinetic energy stimulating the nerve endings in the muscles and joints to develop the small nerve and muscle fibers getting a user stronger.

Located in the housing, labeled as 2, of the suit, certain inner walls can have a substantially cylindrical or substantially circular cross-sectional shape across at least a substantial length thereof will help create kinetic energy in a desired location of the housing which will create a vibration, which the neurological control of the user will sense the vibration and kinetic energy, helping focus on the proprioception. Ultimately helping the user get stronger while building the nerve endings in the muscles while the weight/housing is being moved in all different types of direction while the user moves, side to side, up and down and all around to get the desired kinetic energy for focusing on specific nerves and muscle fibers.

The liquids, labeled as 3, may contain $H_2O$ and salt liquid to give extra weight to the suit. The inner wall that divides the individual housing will be labeled as 4. When working out with this running suit, the fluid path inside of the housing can slosh while the user is moving, creating kinetic energy while developing proprioception and neuromuscular control.

A person skilled in the art will recognize many other articles of clothing or other objects worn or otherwise placed on a user, including humans and animals (e.g., horses), that can incorporate the teachings provided for herein. These include but are not limited to a medical brace, a vest, a shirt, pants, shorts, a backpack, a saddle, and a saddle-like pack.

Polo Mallet/Wand

Figure 5:
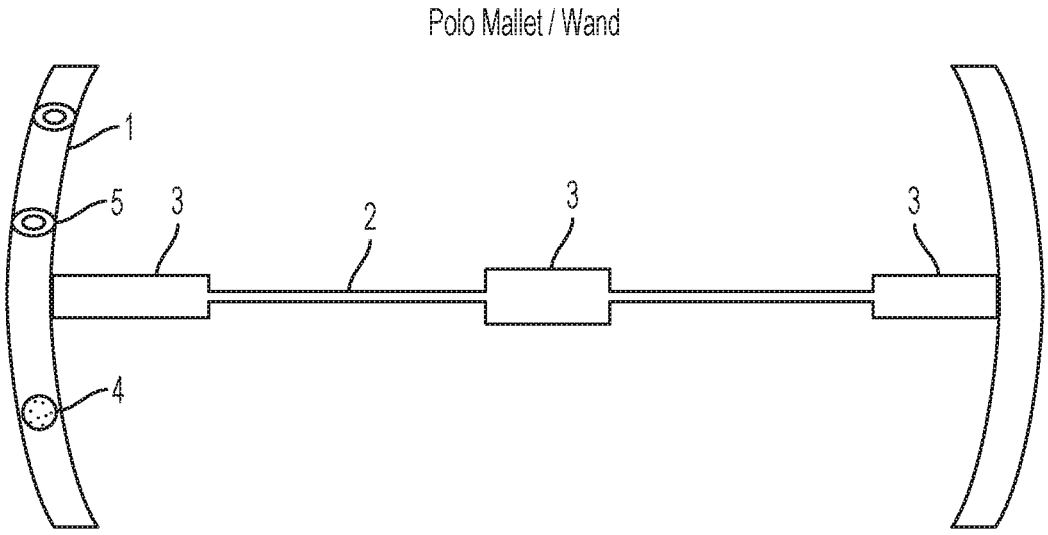
FIG. 5 is a schematic, partial cross-sectional side view of one exemplary embodiment of a playing apparatus (e.g., a polo mallet) of the present disclosure.

FIG. 5 provides for a playing apparatus that is a polo mallet or wand. The housing is labeled as one, the polo mallet (or wand) is labeled as 2, and the hand grip is labeled as 3. Liquids using $H_2O$, salt and stringy plastic is labeled as 4. Washers inside of housing can create inner walls is 5. A person skilled in the art will recognize that in other instances re-deflection walls can be formed along the path, extending radially inward, as taught in other portions of the present application. This device can be used for physical therapy or to maintain and grow nerves and small muscle fiber.

Football

Figure 6:
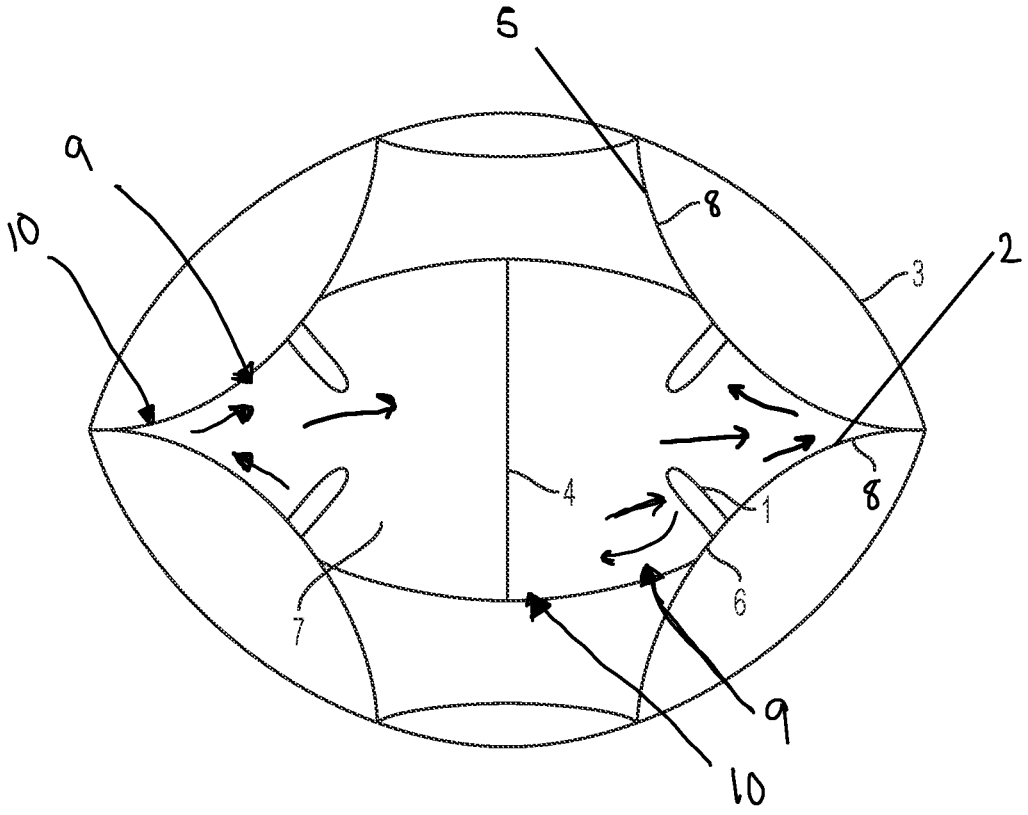
FIG. 6 is a schematic, cross-sectional side view of one exemplary embodiment of a ball (e.g., a football) of the present disclosure.

FIG. 6 provides for a ball that is a football. The inner wall (re-direction wall) is labeled as 1, the housing (inner wall) labeled as 2, the football (outer layer) labeled as 3, the inner wall labeled as 4, the housing (inner wall) labeled as 5, the liquid that is a $H_2O$ solution is labeled as 6, the liquid that is a $H_2O$, salt, corn starch, and BB solution is labeled as 7, and the bladder is labeled as 8. Several non-limiting examples of a fluid path 9 and focus location 10 are shown in FIG. 6. Like indicated throughout this application, any combination of fluids, liquids, and materials can be used in conjunction with any embodiment provided for or otherwise derivable from the present disclosure. This football can be used for strengthening a football player's nerves and small muscle fibers that are important in carrying and maintaining control of a football.

Liquid Weights Inside and Outside of a Baseball Bat

Figure 7:
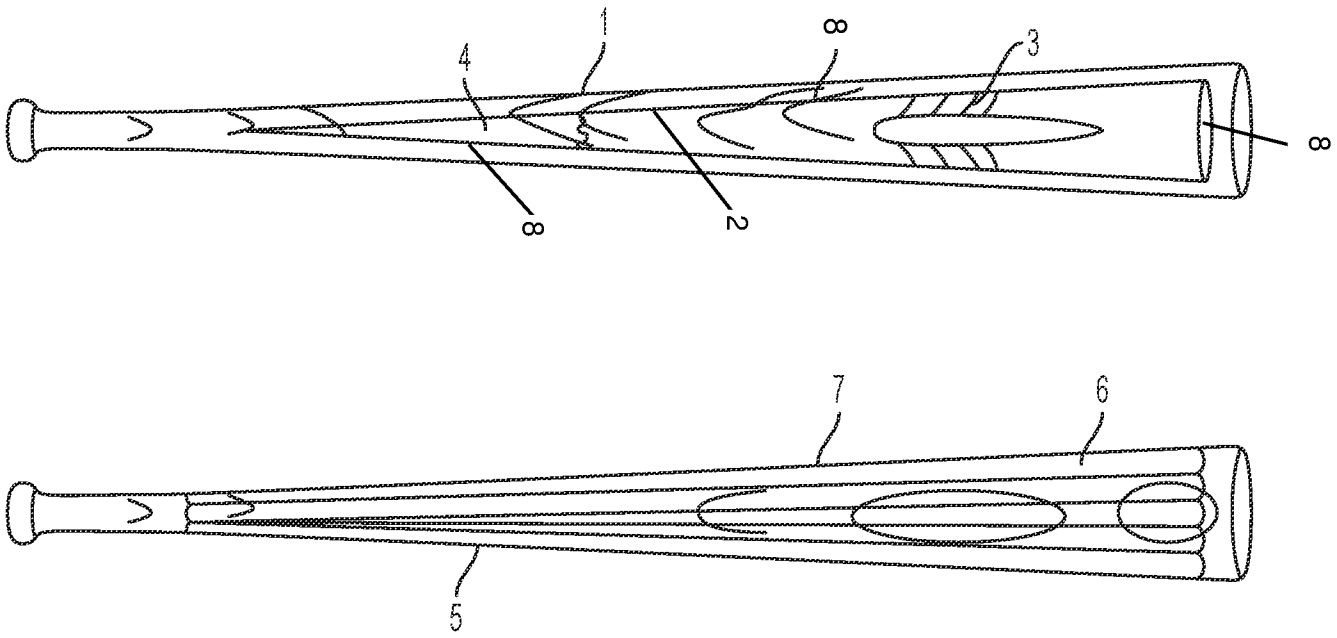
FIG. 7 is a schematic, partially transparent view of another exemplary embodiment of a playing apparatus (e.g., a baseball bat) of the present disclosure, illustrating both an outside and an inside thereof for both a practice bat and a game-ready bat.
Figure 8:
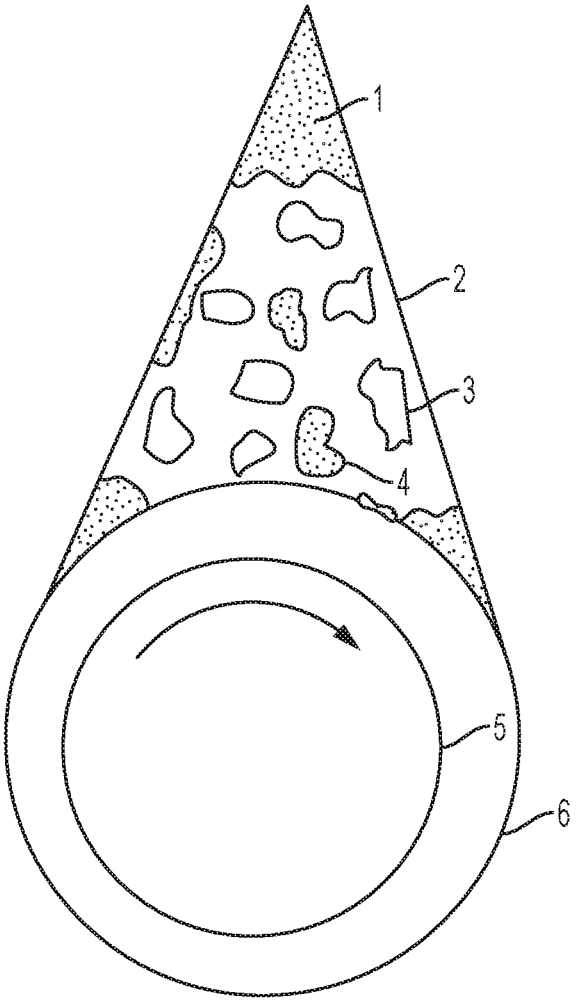
FIG. 8 is a schematic, partially transparent view of an exemplary embodiment of a cone-shaped cylinder that is referred to herein as a tornado of the present disclosure.

FIG. 7 illustrates a playing apparatus that is a baseball bat which incorporates the present disclosures with respect to both an inside and an outside of the bat. In other embodiments, the teachings may only be applied to one of the inside and outside. The teachings can also be applied to other playing devices, such as cricket bats, tennis racquets, golf clubs, lacrosse sticks, and hockey sticks, among others. A baseball bat (housing), labeled as 1, with Liquids Weights on the inside of the practice bat.

Located in the housing of the baseball bat, certain inner walls 2 can have a substantially cylindrical or substantially circular cross-sectional shape across at least a substantial length thereof will help create kinetic energy in a desired location of the housing which will create a vibration, which the neurological control of the user will sense the vibration and kinetic energy, helping focus on the proprioception. Ultimately helping the user get stronger while building the nerve endings in the muscles while the baseball bat/housing is being moved in a swinging position to get the desired kinetic energy for focusing on specific nerves and muscle fibers to help develop the hitting of the baseball motion. A bladder is labeled as 8.

Located inside of the housing, the inner walls (re-direction walls), labeled as 3, can create kinetic energy in the location of the bat to resemble hitting a ball. You can get the same effects in a tennis racquet, hockey stick, cricket bat, lacrosse stick, and golf club, among other playing apparatuses.

The liquids used are $H_2O$, salt and corn starch to create a slosh inside of the housing. Liquids Weights can be designed to go over a real baseball bat, labeled as 5. The cylinder tubes (cover), 6, can go over a baseball bat with liquids inside of the cylinders creating a fluid path within the inner walls of the housing. Cylinder tubes (cover), labeled as 6, can go over the baseball bat. The liquids used can be BB's, $H_2O$, corn starch, and salt. Other inner walls, can include, but are not limited to, rubbery like matter, squares, triangles, and metal discs.

Cone-Shaped Cylinder which is Called the Tornado

The tornado, labeled as 2, can spin the liquids like a tornado on direction and the user can have the option of spinning the wall in the other direction or spinning it back and forth going with the flow of liquids and against the flow of liquids. Certain inner walls can have a substantially cylindrical or substantially circular cross-sectional shape across at least a substantial length thereof will help create kinetic energy in a desired location of the housing which will create a vibration, which the neurological control of the user can sense the vibration and kinetic energy, helping focus on the proprioception. Ultimately helping the user get stronger while building the nerve endings in the muscles while the weight/housing is being moved in all different types of direction while the user moves, side to side, up and down and all around to get the desired kinetic energy for focusing on specific nerves and muscle fibers.

Liquids labeled as 1 can be a solution of salt, $H_2O$, and corn starch. Inner walls, labeled as 3, inner walls with liquids trapped inside, labeled as 4, the grip and handles a user can use, labeled as 5, and an outer grip, labeled as 6.

Liquid

Various materials can be placed in the liquid, including components of different sizes, shapes (circular, cylindrical, rectangular, square, trapezoidal, strings, coils, other known shapes, including free-form shapes), weight, etc. Likewise, the type of liquid can varied to provide different effects. The modification of liquids and fluids can be applied to any of the embodiments provided for herein or otherwise derivable therefrom.

Computer Implementation

Figure 9:
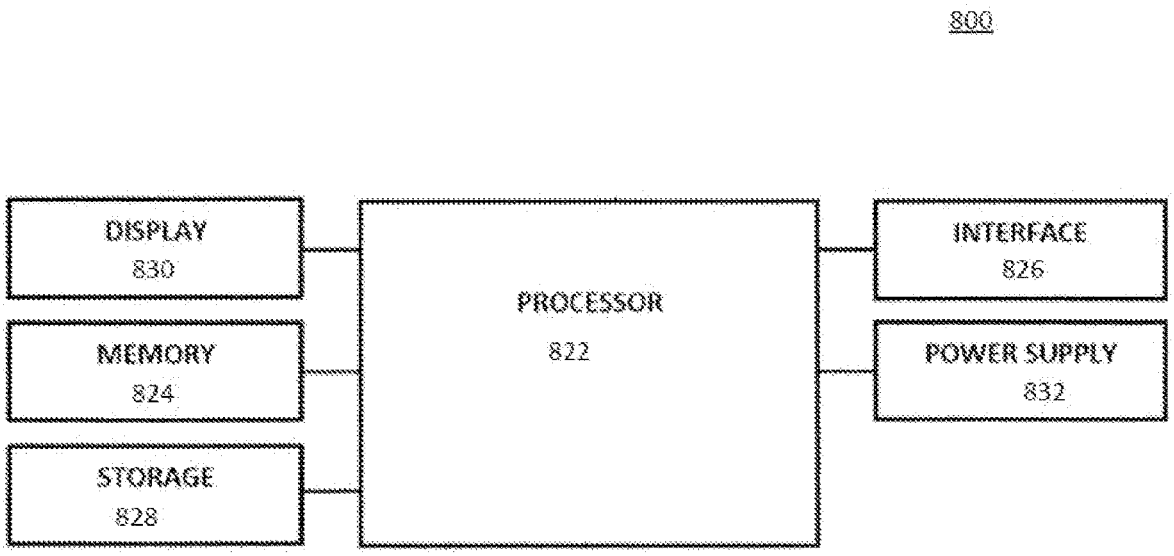
FIG. 9 is a schematic block diagram of one exemplary embodiment of a computer system for controlling a flow of fluid in objects of the nature provided for herein.

FIG. 9 illustrates a block diagram of the physical components of an exemplary embodiment of a controller or other computer 800 that can be used to help control the flow of fluid through the various fluid paths provided for herein. Although an exemplary computer 800 is depicted and described herein, it will be appreciated that this is for sake of generality and convenience. In other embodiments, the computer 800 may differ in architecture and operation from that shown and described here. The computer 800 can be a tablet computer, mobile device, smart device, wearable device, smart phone, laptop computer, desktop computer, cloud-based computer, server computer, a controller associated directly with the object in which the fluid is flowing, multiple of the above, and so forth.

The illustrated computer 800 can include a processor 922 that controls the operation of the computer, for example, by executing embedded software, operating systems, device drivers, application programs, and so forth. The processor 922 can include any type of microprocessor or central processing unit (CPU), including programmable general-purpose or special-purpose processors and/or any of a variety of proprietary or commercially-available single or multi-processor systems. As used herein, the term processor can refer to microprocessors, microcontrollers, ASICs, FPGAs, PICs, processors that read and interpret program instructions from internal or external memory or registers, and so forth. The computer 800 can include a memory 924, which can provide temporary or permanent storage for code to be executed by the processor 922 or for data that is processed by the processor. The memory 924 can include read-only memory (ROM), flash memory, one or more varieties of random access memory (RAM), and/or a combination of memory technologies. The various components of the computer 800 can be interconnected via any one or more separate traces, physical busses, communication lines, etc.

The computer 800 can include an interface 926, such as a communication interface or an I/O interface. A communication interface can enable the computer 800 to communicate with remote devices (e.g., other controllers or computer systems) over a network or communications bus (e.g., a universal serial bus). An I/O interface can facilitate communication between one or more input devices, one or more output devices, and the various other components of the computer 800. For example, the interface 926 can communicate with the computer components of a second computer (e.g., an integrated radio of the second computer). Exemplary input devices include touch screens, mechanical buttons, keyboards, and pointing devices. Additional exemplary output devices include a projector, electronic display screens, and speakers. The computer 800 can include a storage device 928, which can include any conventional medium for storing data in a non-volatile and/or non-transient manner. The storage device 928 can thus hold data and/or instructions in a persistent state (i.e., the value is retained despite interruption of power to the computer 800). The storage device 928 can include one or more hard disk drives, flash drives, USB drives, optical drives, various media disks or cards, and/or any combination thereof and can be directly connected to the other components of the computer 800 or remotely connected thereto, such as through the communication interface. The computer 800 can include a display 930, and can generate images to be displayed thereon. In some embodiments, the display 930 can be a vacuum fluorescent display (VFD), an organic light-emitting diode (OLED) display, or a liquid crystal display (LCD). The computer 800 can include a power supply 932 and appropriate regulating and conditioning circuitry. Exemplary power supplies include batteries, such as polymer lithium ion batteries, or adapters for coupling the computer 800 to a DC or AC power source (e.g., a USB adapter or a wall adapter).

A person skilled in the art, in view of the present disclosures, would understand various ways by which computer implementation can be incorporated into the various objects having fluid disposed therein for purposes of controlling the flow of fluid therein. This can include remote communication with the objects to control the fluid flow and/or communication directly embedded in and/or on the object. As a result, a user can selectively control the flow of fluid to one or more designated focus locations to help strengthen and build particular small muscle fibers and nerves proximate to those locations. Control includes but is not limited to starting, stopping, or otherwise modifying a flow of fluid in amount, duration, location, etc. It can include, but is not limited to, controlling valves and other components used to control fluid flow known to those skilled in the art. A person skilled in the art, in view of the present disclosures, is able to incorporate such control mechanisms along with control systems, like the one illustrated in the present figure.

One skilled in the art will appreciate further features and advantages of the disclosure based on the above-described embodiments. Accordingly, the disclosure is not to be limited by what has been particularly shown and described, except as indicated by the appended claims. Notably, as contemplated at least in the summary and the claims, there are many different types of objects that can be created in view of the present disclosures related to fluid paths, re-direction walls, designated focus locations, and the creation of kinetic energy by virtue of fluid flow and the associated slosh. Thus, while the present disclosure may not explicitly illustrate all of the various options contemplated, they can be readily understood by a person skilled in the art in view of the present disclosures. Further, the various teachings provided for in one embodiment related to features such as fluid paths, re-redirection walls, designated focus locations, the creation of kinetic energy by virtue of fluid flow and the associated slosh, as well as other features, can be easily adopted into the various other embodiments and objects disclosed or even mentioned herein without departing from the spirit of the present disclosure. For the sake of brevity, all of the different combinations and objects that can be created to take advantage of the present disclosures are not included in explicit detail.

All publications and references cited herein are expressly incorporated herein by reference in their entirety.

What is claimed is:

1. A sporting apparatus, wherein the sporting apparatus is one of a ball or a playing apparatus, the sporting apparatus comprising:

when the sporting apparatus is a ball, an outer layer;

when the sporting apparatus is a playing apparatus, a housing having a handle associated therewith;

a fluid path disposed within the outer layer of the ball or within the housing of the playing apparatus, the fluid path being defined by an inner wall having a substantially cylindrical or substantially circular cross-sectional shape across at least a substantial length thereof, the fluid path having at least one designated focus location formed therein;

one or more re-direction walls disposed within the fluid path, the one or more re-direction walls having a distal end fixed to the inner wall of the fluid path and a proximal free end, the proximal free end of the one or more re-direction walls extending radially inward from the inner wall of the fluid path so as to tortuously redirect fluid to a different location along the fluid path than fluid would otherwise travel when passing through the fluid path, the one or more re-direction walls being configured to direct fluid to one or more of the at least one designated focus locations; and a fluid disposed within the fluid path and configured to slosh therein, thereby creating kinetic energy, the fluid being directed through the fluid path to one or more of the at least one designated focus locations based on particular motions applied to the ball when the sporting apparatus is a ball and to the housing by way of a user gripping the handle when the sporting apparatus is a playing apparatus.

2. The sporting apparatus of claim 1, wherein the sporting apparatus is the ball, the ball further comprising:

a bladder disposed within the outer layer, the fluid path disposed within the bladder.

3. The sporting apparatus of claim 1, wherein the sporting apparatus is the ball, and wherein the ball is one of: a football, a rugby ball, a basketball, a soccer ball, a baseball, a cricket ball, a bowling ball, a lacrosse ball, a water polo ball, or a hockey puck.

4. The sporting apparatus of claim 1, wherein the fluid further comprises a liquid having one or more materials disposed in the liquid.

5. The sporting apparatus of claim 1, further comprising one or more fluid control elements configured to at least one of selectively control movement of the fluid through the fluid path, selectively control movement of the fluid to the at least one or more of the at least one designated focus locations, or selectively control movement of the fluid with respect to contacting the one or more re-direction walls.

6. The sporting apparatus of claim 1, wherein the one or more of the at least one designated focus locations is disposed at a location that is conducive to create kinetic energy to build at least one of small muscle fibers or nerves for a user.

7. The sporting apparatus of claim 1, wherein the sporting apparatus is the playing apparatus, and the housing comprises one of:

a throat and a racquet head, and the playing apparatus is a tennis racquet;

a barrel, and the playing apparatus is a bat;

a shaft and a mallet head, and the playing apparatus is a polo mallet;

a shaft and a head having a pocket associated therewith, and the playing apparatus is a lacrosse stick;

a shaft and a blade, and the playing apparatus is a hockey stick; or a shaft and a head, and the playing apparatus is a golf club.

8. The sporting apparatus of claim 7, where the sporting apparatus is the tennis racquet.

9. The sporting apparatus of claim 7, where the sporting apparatus is the bat.

10. The sporting apparatus of claim 7, where the sporting apparatus is the polo mallet.

11. The sporting apparatus of claim 7, where the sporting apparatus is the lacrosse stick.

12. The sporting apparatus of claim 7, where the sporting apparatus is the hockey stick.

13. The sporting apparatus of claim 7, where the sporting apparatus is the golf club.

14. A ball, comprising:

an outer layer;

a fluid path disposed within the outer layer, the fluid path being defined by an inner wall having a substantially cylindrical or substantially circular cross-sectional shape across at least a substantial length thereof, the fluid path having at least one designated focus location formed therein;

one or more re-direction walls disposed within the fluid path, the one or more-redirection walls having a distal end fixed to the inner wall of the fluid path and a proximal free end, the proximal free end of the one or more re-direction walls extending radially inward from the inner wall of the fluid path so as to tortuously redirect fluid to a different location along the fluid path than fluid travel would otherwise travel when passing through the fluid path, the one or more re-direction walls being configured to direct fluid to one or more of the at least one designated focus locations; and a fluid disposed within the fluid path and configured to slosh therein, thereby creating kinetic energy, the fluid being directed through the fluid path to one or more of the at least one designated focus locations based on particular motions applied to the ball.

15. The ball of claim 14, further comprising a bladder disposed within the outer layer; the fluid path being disposed within the bladder.

16. The ball of claim 14, wherein the ball is one of: a football, a rugby ball, a basketball, a soccer ball, a baseball, a cricket ball, a bowling ball, a lacrosse ball, a water polo ball, or a hockey puck.

17. The ball of claim 14, wherein the fluid further comprises a liquid having one or more materials disposed in the liquid.

18. The ball of claim 14, further comprising one or more fluid control elements configured to at least one of selectively control movement of the fluid through the fluid path, selectively control movement of the fluid to the at least one or more of the at least one designated focus locations, or selectively control movement of the fluid with respect to contacting the one or more re-direction walls.

19. The ball of claim 14, wherein the one or more of the at least one designated focus locations is disposed at a location that is conducive to create the desired kinetic energy to build at least one of small muscle fibers or nerves for a user.

20. An article of clothing, comprising:

an outer layer configured to be worn as apparel;

a fluid path disposed within the outer layer, the fluid path being defined by an inner wall having a substantially cylindrical or substantially circular cross-sectional shape across at least a substantial length thereof, the fluid path having at least one designated focus location formed therein;

one or more re-direction walls disposed within the fluid path, the one or more-redirection walls having a distal end fixed to the inner wall of the fluid path and a proximal free end, the proximal free end of the one or more re-direction walls extending radially inward from the inner wall of the fluid path so as to tortuously redirect fluid to a different location along the fluid path than fluid travel would otherwise travel when passing through the fluid path, the one or more re-direction walls being configured to direct fluid to one or more of the at least one designated focus locations; and a fluid disposed within the fluid path and configured to slosh therein, thereby creating kinetic energy, the fluid being directed through the fluid path to one or more of the at least one designated focus locations based on particular motions applied to the article of clothing.

21. The article of clothing of claim 20, wherein the article of clothing is one of: a medical brace, a vest, a shirt, pants, shorts, a backpack, a horse wrap, a saddle, or a saddle-like pack.

22. The article of clothing of claim 20, wherein the fluid further comprises a liquid having one or more materials disposed in the liquid.

23. The article of clothing of claim 20, further comprising one or more fluid control elements configured to at least one of selectively control movement of the fluid through the fluid path, selectively control movement of the fluid to the at least one or more of the at least one designated focus locations, or selectively control movement of the fluid with respect to contacting the one or more re-direction walls.

24. The article of clothing of claim 20, wherein the one or more of the at least one designated focus locations is disposed at a location that is conducive to create the desired kinetic energy to build at least one of small muscle fibers or nerves for a user.

25. A method of building at least one of muscle or nerves, comprising:

applying a force to an object having a fluid path formed therein, the fluid path being defined by an inner wall having a substantially cylindrical or substantially circular cross-sectional shape across at least a substantial length thereof, with one or more re-direction walls having a distal end fixed to the inner wall of the fluid path and a proximal free end, the proximal free end of the one or more re-direction walls extending radially inward from the inner wall of the fluid path, wherein applying the force to the object causes fluid disposed within the fluid path to slosh therein, thereby creating kinetic energy, such that portions of the fluid make contact with at least one of the one or more re-direction walls to direct the fluid to at least one designated focus location based on the force applied to the object to strengthen at least one of small muscle fibers or nerves of a user applying the force, wherein the object is one of: a ball, a playing apparatus, or an article of clothing, wherein when the object is a ball, the ball is one of: a football, a rugby ball, a basketball, a soccer ball, a baseball, a cricket ball, a bowling ball, a lacrosse ball, a water polo ball, or a hockey puck, wherein when the object is a playing apparatus, the playing apparatus is one of: a tennis racquet, a bat, a polo mallet, a lacrosse stick, a hockey stick, or a golf club, and wherein when the object is an article of clothing, the article of clothing is one of: a medical brace, a vest, a shirt, pants, shorts, a backpack, a horse wrap, a saddle, or a saddle-like pack.

26. The method of muscle building of claim 25, further comprising:

adjusting at least one of the fluid path or a location of the one or more re-direction walls to adjust a manner by which fluid passes through the fluid path.

27. A sporting apparatus, wherein the sporting apparatus is one of a ball or a playing apparatus, the sporting apparatus comprising:

when the sporting apparatus is a ball, an outer layer and a bladder disposed within the outer layer;

when the sporting apparatus is a playing apparatus, a housing having a handle associated therewith and a bladder disposed within the housing;

a fluid path disposed within the bladder of the ball or within the bladder of the playing apparatus, the fluid path being defined by an inner wall having a substantially cylindrical or substantially circular cross-sectional shape across at least a substantial length thereof, the fluid path having at least one designated focus location formed therein;

one or more re-direction walls disposed within the fluid path, the one or more re-direction walls extending radially inward from the inner wall of the fluid path so as to tortuously redirect fluid to a different location along the fluid path than fluid would otherwise travel when passing through the fluid path, the one or more re-direction walls being configured to direct fluid to one or more of the at least one designated focus locations; and a fluid disposed within the fluid path and configured to slosh therein, thereby creating kinetic energy, the fluid being directed through the fluid path to one or more of the at least one designated focus locations based on particular motions applied to the ball when the sporting apparatus is a ball and to the housing by way of a user gripping the handle when the sporting apparatus is a playing apparatus.

28. A sporting apparatus, wherein the sporting apparatus is one of a ball or a playing apparatus, the sporting apparatus comprising:

when the sporting apparatus is a ball, an outer layer and a cover removably disposed over the outer layer;

when the sporting apparatus is a playing apparatus, a housing having a handle associated therewith and a cover removably disposed over the housing;

a fluid path disposed within the cover of the ball or within the cover of the playing apparatus, the fluid path being defined by an inner wall having a substantially cylindrical or substantially circular cross-sectional shape across at least a substantial length thereof, the fluid path having at least one designated focus location formed therein;

one or more re-direction walls disposed within the fluid path, the one or more re-direction walls extending inward from the inner wall tortuously redirecting fluid to a different location along the fluid path than fluid would otherwise travel when passing through the fluid path, the one or more re-direction walls being configured to direct fluid to one or more of the at least one designated focus locations; and a fluid disposed within the fluid path and configured to slosh therein, thereby creating kinetic energy, the fluid being directed through the fluid path to one or more of the at least one designated focus locations based on particular motions applied to the ball when the sporting apparatus is a ball and to the housing by way of a user gripping the handle when the sporting apparatus is a playing apparatus.

29. A sporting apparatus, wherein the sporting apparatus is one of a ball or a playing apparatus, the sporting apparatus comprising:

when the sporting apparatus is a ball, an outer layer and a bladder disposed within the outer layer;

when the sporting apparatus is a playing apparatus, a housing having a handle associated therewith;

a fluid path disposed within the bladder of the ball or within the housing of the playing apparatus, the fluid path being defined by an inner wall having a substantially cylindrical or substantially circular cross-sectional shape across at least a substantial length thereof, the fluid path having at least one designated focus location formed therein;

one or more re-direction walls disposed within the fluid path, the one or more re-direction walls extending radially inward from the inner wall of the fluid path so as to tortuously redirect fluid to a different location along the fluid path than fluid would otherwise travel when passing through the fluid path, the one or more re-direction walls being configured to direct fluid to one or more of the at least one designated focus locations; and a fluid disposed within the fluid path and configured to slosh therein, thereby creating kinetic energy, the fluid being directed through the fluid path to one or more of the at least one designated focus locations based on particular motions applied to the ball when the sporting apparatus is a ball and to the housing by way of a user gripping the handle when the sporting apparatus is a playing apparatus, wherein the sporting apparatus is the ball.

30. A device, comprising:

an outer layer;

a bladder disposed within the outer layer;

a fluid path disposed within the bladder, the fluid path being defined by an inner wall having a substantially cylindrical or substantially circular cross-sectional shape across at least a substantial length thereof, the fluid path having at least one designated focus location formed therein;

one or more re-direction walls disposed within the fluid path, the one or more-redirection walls extending radially inward from the inner wall of the fluid path so as to tortuously redirect fluid to a different location along the fluid path than fluid travel would otherwise travel when passing through the fluid path, the one or more re-direction walls being configured to direct fluid to one or more of the at least one designated focus locations; and a fluid disposed within the fluid path and configured to slosh therein, thereby creating kinetic energy, the fluid being directed through the fluid path to one or more of the at least one designated focus locations based on particular motions applied to the device.

* * * * *